US006431720B1

(12) United States Patent
Cheng

(10) Patent No.: US 6,431,720 B1
(45) Date of Patent: Aug. 13, 2002

(54) LASER PEN WITH SAFETY POWER CUTOFF DEVICE

(76) Inventor: Dido Cheng, 4C-27 Trade Mart, Taipei World Trade Center, No. 5, Hsen Yi Road, Sec 5, Taipei (TW)

( * ) Notice: Subject to any disclaimer, the term of this patent is extended or adjusted under 35 U.S.C. 154(b) by 0 days.

(21) Appl. No.: 09/527,620

(22) Filed: Mar. 17, 2000

(51) Int. Cl.[7] ..... B43K 29/10

(52) U.S. Cl. ..... 362/118; 362/259; 362/205; 362/276; 362/802; 362/579

(58) Field of Search ..... 362/118, 259, 362/205, 276, 802, 579, 194, 195; 250/227.13

(56) References Cited

U.S. PATENT DOCUMENTS 5,544,967 A * 8/1996 Yao ..... 362/118
5,617,304 A * 4/1997 Huang ..... 362/118
5,803,583 A * 9/1998 Hsieh ..... 362/118
6,024,467 A * 2/2000 Liu ..... 362/259

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

A laser pen includes a metallic barrel, a laser device mounted in the upper portion of the metallic barrel, a safety power cutoff device having an insulating tube secured in the lower portion of the metallic barrel, a plurality of batteries received in the upper portion of the insulating tube and electrically connecting to the laser device, a reservoir tube having a top portion including a metallic contact head movably mounted in the lower portion of the insulating tube and detachably contacting one of the batteries, and a rotating device mounted on the lower portion of the metallic barrel and engaged with the metallic contact head of the reservoir tube for moving the metallic contact head.

4 Claims, 4 Drawing Sheets

PRIOT ART

LASER PEN WITH SAFETY POWER CUTOFF DEVICE

BACKGROUND OF THE INVENTION

1. Field of the Invention

The present invention relates to a laser pen, and more particularly to a laser pen with a safety power cutoff device.

2. Description of the Related Arts

A conventional laser pen 80 in accordance with the prior art shown in FIG. 5 comprises a barrel 82, a plurality of batteries 84 mounted in the barrel 82, a laser device 85 mounted in the barrel 82 for emitting laser light outward from the barrel 82 and including a circuit board 86 connected to one of the batteries 84, and a press button 88 detachably contacting the circuit board 86. When the press button 88 is pressed to touch the circuit board 86, the laser device 85 will emit a beam of laser light outward from the barrel 82. However, when a user is writing with the laser pen, he may unintentionally touch and press the press button 88 to emit the laser light outward from the barrel 82 to project onto the user's eyes, thereby easily hurting the user's eyes.

SUMMARY OF THE INVENTION

In accordance with one aspect of the present invention, there is provided a laser pen comprising a metallic barrel having an upper portion and a lower portion; a laser device mounted in the upper portion of the metallic barrel; a safety power cutoff device including an insulating tube secured in the lower portion of the metallic barrel and having an upper portion and a lower portion; at least one battery received in the upper portion of the insulating tube and electrically connecting to the laser device; a reservoir tube having a top portion including a metallic contact head movably mounted in the lower portion of the insulating tube and detachably contacting the at least one battery; and a rotating device mounted on the lower portion of the metallic barrel and engaged with the metallic contact head of the reservoir tube for moving the metallic contact head.

The insulating tube includes a receiving chamber defined in the upper end thereof for receiving the at least one battery, and a guide chamber defined in the lower portion thereof for movably guiding the metallic contact head of the reservoir tube. The receiving chamber has a diameter greater than that of the guide chamber, thereby defining an annular holding shoulder therebetween for stopping the battery.

The laser device includes a fixing sleeve having a lower portion secured in the upper portion of the metallic barrel and an upper portion protruding outward from the metallic barrel, a cover secured on the upper portion of the fixing sleeve, a metallic light source housing secured to the lower portion of the fixing sleeve, a circuit board having a first side connected to the light source housing, a conducting spring mounted between a second side of the circuit board and the at least one battery, a press button switch mounted on the circuit board, and a press button slidably extending through the metallic barrel and detachably engaged with the press button switch.

The rotating device includes a metallic support tube secured in the lower portion of the insulating tube, a metallic engaging portion mounted on a lower portion of the support tube and secured to the lower portion of the metallic barrel, a metallic slide tube slidably mounted in the support tube and securely engaged with the metallic contact head of the reservoir tube for moving the metallic contact head, and a pen head rotatably mounted on the lower portion of the support tube and engaged with the slide tube for moving the slide tube.

The slide tube includes an inner thread, and the contact head of the reservoir tube includes an outer thread screwed into the inner thread of the slide tube.

The laser pen further comprises a conducting spring mounted on the reservoir and connecting between the metallic contact head of the reservoir tube and the metallic support tube.

Further benefits and advantages of the present invention will become apparent after a careful reading of the detailed description with appropriate reference to the accompanying drawings.

DETAILED DESCRIPTION OF THE INVENTION

Figure 1:
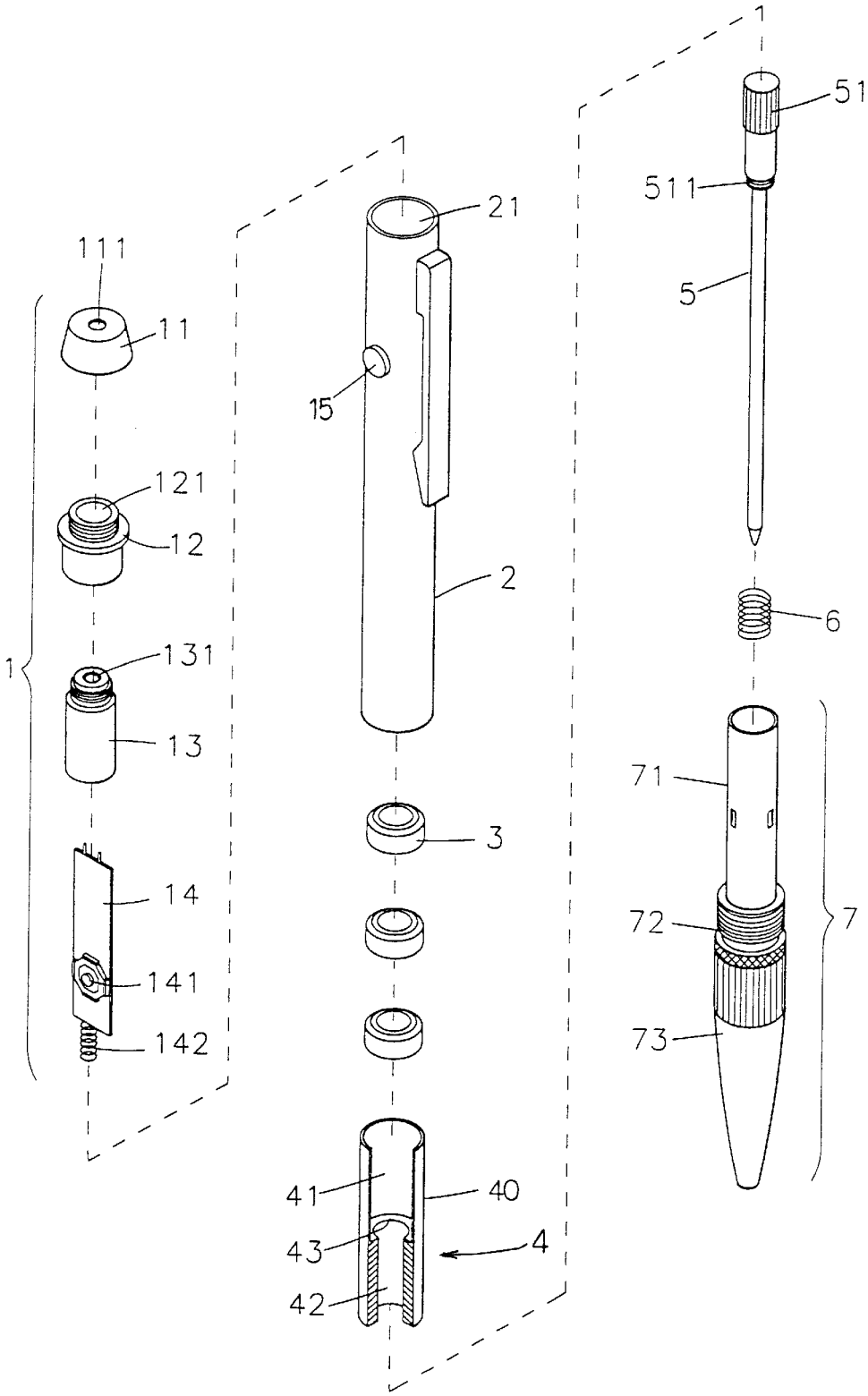
FIG. 1 is an exploded view of a laser pen with a safety power cutoff device in accordance with the present invention.
Figure 2:
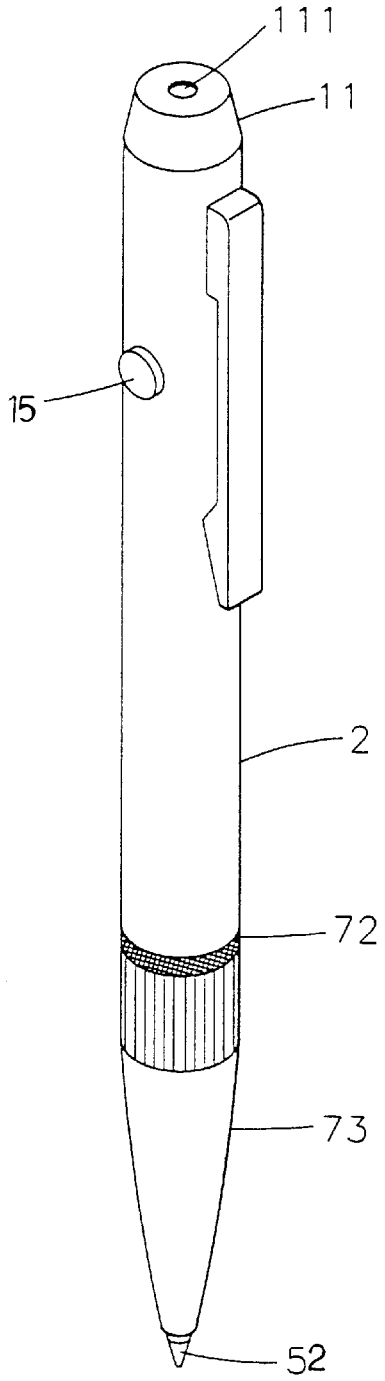
FIG. 2 is a perspective assembly view of the laser pen as shown in FIG. 1.
Figure 3:
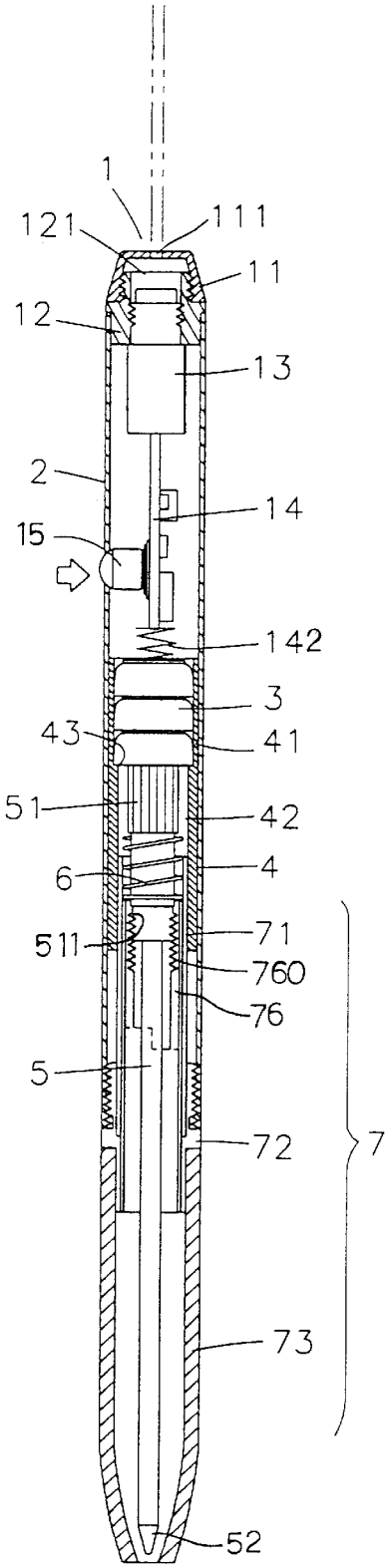
FIG. 3 is a side plan cross-sectional view of the laser pen as shown in FIG. 2.

Referring to the drawings and initially to FIGS. 1–3, a laser pen in accordance with the present invention comprises a metallic barrel 2 having an upper portion and a lower portion and defining a receiving hole 21, a laser device 1 mounted in the upper portion of the metallic barrel 2, a safety power cutoff device 4 including an insulating tube 40 secured in the lower portion of the metallic barrel 2 and having an upper portion and a lower portion, a plurality of batteries 3 received in the upper portion of the insulating tube 40 and electrically connecting to the laser device 1, a reservoir tube 5 having a top portion including a metallic contact head 51 movably mounted in the lower portion of the insulating tube 40 and detachably contacting a bottom one of the batteries 3, and a rotating device 7 mounted on the lower portion of the metallic barrel 2 for receiving the reservoir tube 5 and engaged with the metallic contact head 51 of the reservoir tube 5 for moving the metallic contact head 51 in the insulating tube 40 to contact the bottom battery 3.

The insulating tube 40 includes a receiving chamber 41 defined in the upper end thereof for receiving the batteries 3, and a guide chamber 42 defined in the lower portion thereof for movably guiding the metallic contact head 51 of the reservoir tube 5. The receiving chamber 41 has a diameter greater than that of the guide chamber 42, thereby defining an annular holding shoulder 43 therebetween for stopping and holding the batteries 3.

The laser device 1 includes a fixing sleeve 12 defining a receiving hole 121 and having a lower portion secured in the upper portion of the metallic barrel 2 and an upper portion protruding outward from the metallic barrel 2, a cover 11 secured on the upper portion of the fixing sleeve 12 and defining a through hole 111, a metallic light source housing 13 secured to the lower portion of the fixing sleeve 12 and defining a light passing aperture 131, a focus concentration lens (not shown) mounted in the light source housing 13, a laser diode (not shown) mounted in the light source housing 13, a circuit board 14 having a first side connected to the light source housing 13, a conducting spring 142 mounted between a second side of the circuit board 14 and a top one of the batteries 3, a press button switch 141 mounted on the circuit board 14, and a press button 15 slidably extending through the metallic barrel 2 and detachably engaged with the press button switch 141.

The rotating device 7 includes a metallic support tube 71 secured in the guide chamber 42 of the lower portion of the insulating tube 40, a metallic engaging portion 72 mounted on a lower portion of the support tube 71 and secured to the lower portion of the metallic barrel 2 for attaching the rotating device 7 to the metallic barrel 2, a metallic slide tube 76 slidably mounted in the support tube 71 and securely engaged with the metallic contact head 51 of the reservoir tube 5 for moving the metallic contact head 51 in the guide chamber 42 of the insulating tube 40, and a pen head 73 rotatably mounted on the lower portion of the support tube 71 and engaged with the slide tube 76 for moving the slide tube 76 in the support tube 71. The pen head 73 has a hollow upper portion extending into the inside of the support tube 71 and defining a helical groove (not shown) therein. The slide tube 76 has a lower portion movably received in the hollow upper portion of the pen head 73 and including a stub (not shown) protruding outward and slidably received in the helical groove. When the pen head 73 is rotated relative to the support tube 71, the helical groove is rotated with the pen head 73 so that the stub is moved in the helical groove so as to move the slide tube 76 upward or downward. The operation of the rotating device 7 is conventional and will not be further described in detail.

The slide tube 67 includes an inner thread 760, and the contact head 51 of the reservoir tube 5 includes an outer thread 511 screwed into the inner thread 760 of the slide tube 67 for securing the contact head 51 to the slide tube 76 so that the contact head 51 is moved with the slide tube 76.

The laser pen further comprises a conducting spring 6 mounted on the reservoir 5 and connecting between the metallic contact head 51 of the reservoir tube 5 and the metallic support tube 71.

Figure 4:
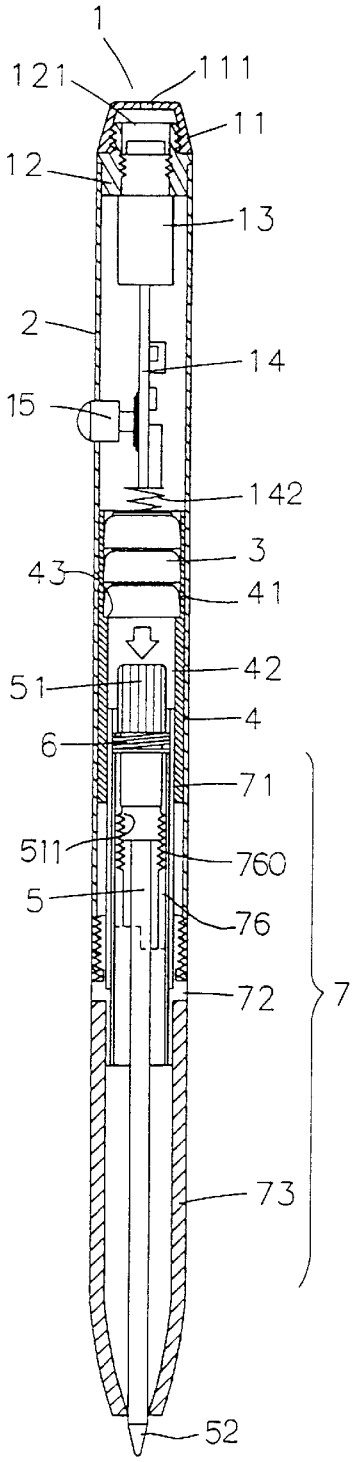
FIG. 4 is an operational view of the laser pen as shown in FIG. 3.
Figure 5:
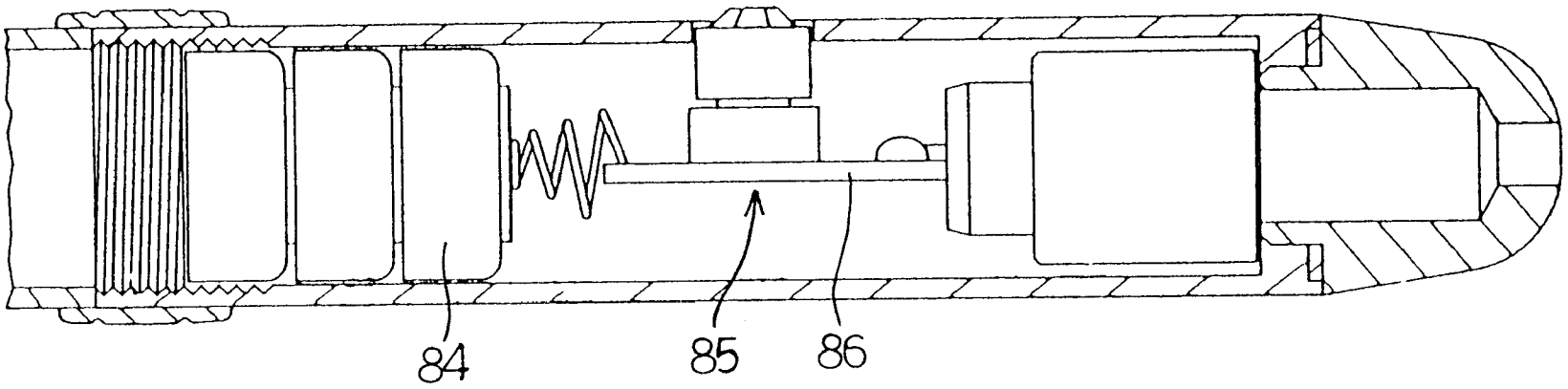
FIG. 5 is a front plan cross-sectional view of a conventional laser pen in accordance with the prior art.

In operation, referring to FIGS. 3 and 4 with reference to FIGS. 1 and 2, the reservoir tube 5 is initially retracted into the pen head 73 of the rotating device 7 so that the contacting head 51 of the reservoir tube 5 is retained in contact with the positive electrode of the bottom battery 3 as shown in FIG. 3.

The negative electrode of the top battery 3 is connected to the conducting spring 142 which is connected to the circuit board 14 which is connected to the negative end of the laser diode of the light source housing 13 whose positive end is directly connected via conduction of the metallic light source housing 13 to the metallic barrel 2 which is connected to the support tube 71 which is connected to the conducting spring 6 which is connected to the contacting head 51 which is connected to the positive electrode of the bottom battery 3 as shown in FIG. 3, thereby forming a complete circuit.

In such a manner, when the press button 15 is pressed to touch the press button switch 141 of the laser device 1, the circuit of the circuit board 14 of the laser device 1 is conducted so as to conduct the light source housing 13 which operates the laser diode to emit a beam of laser light through the focus concentration lens, the light passing aperture 131, and the through hole 11 of the cover 11, thereby providing an indication function.

The pen head 73 can be rotated relative to the support tube 71 to move the slide tube 76 downward which in turn moves the contact head 51 downward from the position as shown in FIG. 3 to the position as shown in FIG. 4 to protrude the tip 52 of the reservoir tube 5 from the pen head 73, thereby detaching the contact head 51 from the bottom batter 3 so as to break the circuit so that the laser device 1 is disposed in an "OFF" status. In such a manner, the circuit is actually cut off so that the laser diode of the light source housing 13 will not emit laser light outward through the through hole 111 even when the press button 15 is unintentionally pressed, thereby efficiently protecting the user from being projected by the laser light when he is writing with the pen.

It should be clear to those skilled in the art that further embodiments may be made without departing from the scope of the present invention.

What is claimed is:

1. A laser pen comprising:

a metallic barrel (2) having an upper portion and a lower portion;

a laser device (1) mounted in said upper portion of said metallic barrel (2);

a safety power cutoff device (4) including an insulating tube (40) secured in said lower portion of said metallic barrel (2) and having an upper portion and a lower portion;

at least one battery (3) received in said upper portion of said insulating tube (40) and electrically connected to said laser device (1);

a reservoir tube (5) having a top portion including a metallic contact head (51) movably mounted in said lower portion of said insulating tube (40) and detachably contacting said at least one battery (3); and a rotating device (7) rotatably mounted on said lower portion of said metallic barrel (2) and engaged with said metallic contact head (51) of said reservoir tube (5) for moving said metallic contact head (51) in said insulating tube (40); wherein said laser device (1) includes a fixing sleeve (12) having a lower portion secured in said upper portion of said metallic barrel (2) and an upper portion protruding outward from said metallic barrel (2), a cover (11) secured on said upper portion of said fixing sleeve (12), a metallic light source housing (13) secured to said lower portion of said fixing sleeve (12), a circuit board (14) having a first side connected to said light source housing (13), a conducting spring (142) mounted between a second side of said circuit board (14) and said at least one battery (3), a press button switch (141) mounted on said circuit board (14), and a press button (15) slidably extending through said metallic barrel (2) and detachably engaged with said press button switch (141);

said insulating tube (40) includes a receiving chamber (41) defined in the upper end thereof for receiving said at least one battery (3), and a guide chamber (42) defined in the lower portion thereof for movably guiding said metallic contact head (51) of said reservoir tube (5);

said receiving chamber (41) has a diameter greater than that of said guide chamber (42), thereby defining an annular holding shoulder (43) therebetween for supporting and holding said at least one battery (3) in said receiving chamber; and said rotating device is rotated to move said metallic contact head (51), so that said metallic contact head (51) is moved in said guide member (42) of said insulating tube (40) between a first position where said metallic contact head (51) is in contact with said at least one battery (3), thereby forming an electrical connection status, and a second position where said metallic contact head (51) is detached from said at least one battery (3), thereby forming an electrical disconnection status.

2. The laser pen in accordance with claim 1, wherein said rotating device (7) includes a metallic support tube (71) secured in said lower portion of said insulating tube (40), a metallic engaging portion (72) mounted on a lower portion of said support tube (71) and secured to said lower portion of said metallic barrel (2), a metallic slide tube (76) slidably mounted in said support tube (71) and securely engaged with said metallic contact head (51) of said reservoir tube (5) for moving said metallic contact head (51), and a pen head (73) rotatably mounted on said lower portion of said support tube (71) and engaged with said slide tube (76) for moving said slide tube (76).

3. The laser pen in accordance with claim 2, wherein said slide tube (67) includes an inner thread (760), and said contact head (51) of said reservoir tube (5) includes an outer thread (511) screwed into said inner thread (760) of said slide tube (67).

4. The laser pen in accordance with claim 2, further comprising a conducting spring (6) mounted on said reservoir (5) and connecting between said metallic contact head (51) of said reservoir tube (5) and said metallic support tube (71).

* * * * *